United States Patent [19]

Rosenstock et al.

[11] 4,053,113

[45] Oct. 11, 1977

[54] DRY GRINDING PROCESS FOR REDUCING ORE TO PELLETIZABLE PARTICLES

[75] Inventors: Friedrich Rosenstock; Walter Hastik, both of Frankfurt am Main; Reinhold Becker, Bad Homburg, all of Germany

[73] Assignee: Metallgesellschaft Aktiengesellschaft, Frankfurt am Main, Germany

[21] Appl. No.: 726,486

[22] Filed: Sept. 24, 1976

[30] Foreign Application Priority Data

Oct. 10, 1975 Germany ..... 2545424

[51] Int. Cl.[2] ..... B02C 23/12

[52] U.S. Cl. ..... 241/30; 241/34

[58] Field of Search ..... 241/34, 30

[56] References Cited

U.S. PATENT DOCUMENTS

| | | | |
|---|---|---|---|
| 3,114,510 | 12/1963 | McCarty et al. | 241/34 |
| 3,401,891 | 9/1968 | Fleeman et al. | 241/34 |
| 3,860,804 | 1/1975 | Rutman | 241/34 |

*Primary Examiner*—Granville Y. Custer, Jr.
*Attorney, Agent, or Firm*—Karl F. Ross

[57] ABSTRACT

A dry grinding process for reducing ore to pelletizable particles comprises grinding the ore in a size-reducing unit and classfiying the ore in a centrifugal pneumatic separator which is automatically controlled to make the coarse fraction available at a substantially constant rate. The coarse fraction is recycled to the size-reducing unit and the total rate of fed ore and recycled coarse fraction is maintained substantially constant. The ore-feeding rate is varied when, and only when, a controlled variable of the pneumatic separator has a deviation in excess of a predetermined permissible deviation.

4 Claims, 2 Drawing Figures

DRY GRINDING PROCESS FOR REDUCING ORE TO PELLETIZABLE PARTICLES

FIELD OF THE INVENTION

This invention relates to a dry grinding process for reducing ore to pelletizable particles, which process comprises grinding the ore in a size-reducing unit, classifying the ore in a pneumatic separator, recycling the coarse fraction into the size-reducing unit, discharging the remaining fraction as a finished product and maintaining a substantially constant total rate of ore feed and recycled coarse fraction.

BACKGROUND OF THE INVENTION

When ore is dry-ground in a closed cycle to pelletizable particles it is necessary for the production of pellets of uniform quality to obtain a finished product which is as uniform as possible and at a rate which is as constant as possible. For a good finished product, the material discharged from the mill must be classified and the coarse fraction obtained by the classification must be recycled to the mill. Also, the rate at which material is fed to the mill must be maintained as constant as possible.

To feed material to the mill at a constant rate, it is known to maintain a constant total rate of ore feed and recycled coarse fraction and to change the ore feed rate in compensation of a change of the coarse fraction recycle rate (Printed German Application 1,208,160; Printed German Application 1,002,596; Printed German Application 1,182,032).

Even if the nature of the ore and the operating conditions remain the same, there will be periodic fluctuations of the rate at which the coarse fraction becomes available. In the known process these fluctuations are compensated immediately by a corresponding change of the ore feed rate. This automatic control results in variations in the overall system, and these variations can often build up so strongly that the operation is temporarily terminated or restricted. The quality of the finished product also varies very strongly.

OBJECT OF THE INVENTION

It is an object of the invention to prevent these disadvantages and particularly to ensure a troublefree operation under optimum conditions and the production of a uniform finished product of high quality.

SUMMARY OF THE INVENTION

This object is accomplished according to the invention in that the total rate of fed ore and recycled coarse fraction is maintained substantially constant in that the ratio of ore feed rate to coarse fraction recycle rate is maintained constant. For this purpose a centrifugal pneumatic separator is automatically controlled to make coarse fraction available at a substantially constant rate. The ore-feeding rate is varied when, and only when, a controlled variable of the pneumatic separator exhibits a deviation in excess of a predetermined, permissible deviation.

The size-reducing units consist generally of tube mills. A diagrammatic description of a particularly suitable centrifugal pneumatic separator and its mode of operation are apparent from Schubert "Aufbereitung fester mineralischer Rohstoffe", Vol. 1, VEB Deutscher Verlag fur Grundstoffindustrie, Leipzig 1968, page 289.

According to a preferred feature the automatic control of the centrifugal pneumatic separator is accomplished by a change of the speed of fan of the pneumatic separator. This enables a simple and effective, automatic control. Alternatively, the automatic control may be accomplished by a change of the speed of the fanwheel or by an adjustment of the guide vanes.

According to a preferred feature, the permissible deviation of the controlled variable in the centrifugl pneumatic separator is the permissible deviation of the particle size spectrum of the finished product and the ore-feeding rate is changed when this permissible deviation is exceeded. This practice enables simple supervision of the permissible deviation and ensures the production of a satisfactory finished product.

According to a preferred feature, the ore feed rate is changed in steps when the permissible deviation has been exceeded. This prevents an overshooting of the automatic control.

BRIEF DESCRIPTION OF THE DRAWING

The invention will be explained more fully and by way of example with reference to the accompanying drawing, in which.

SPECIFIC DESCRIPTION

Figure 1:
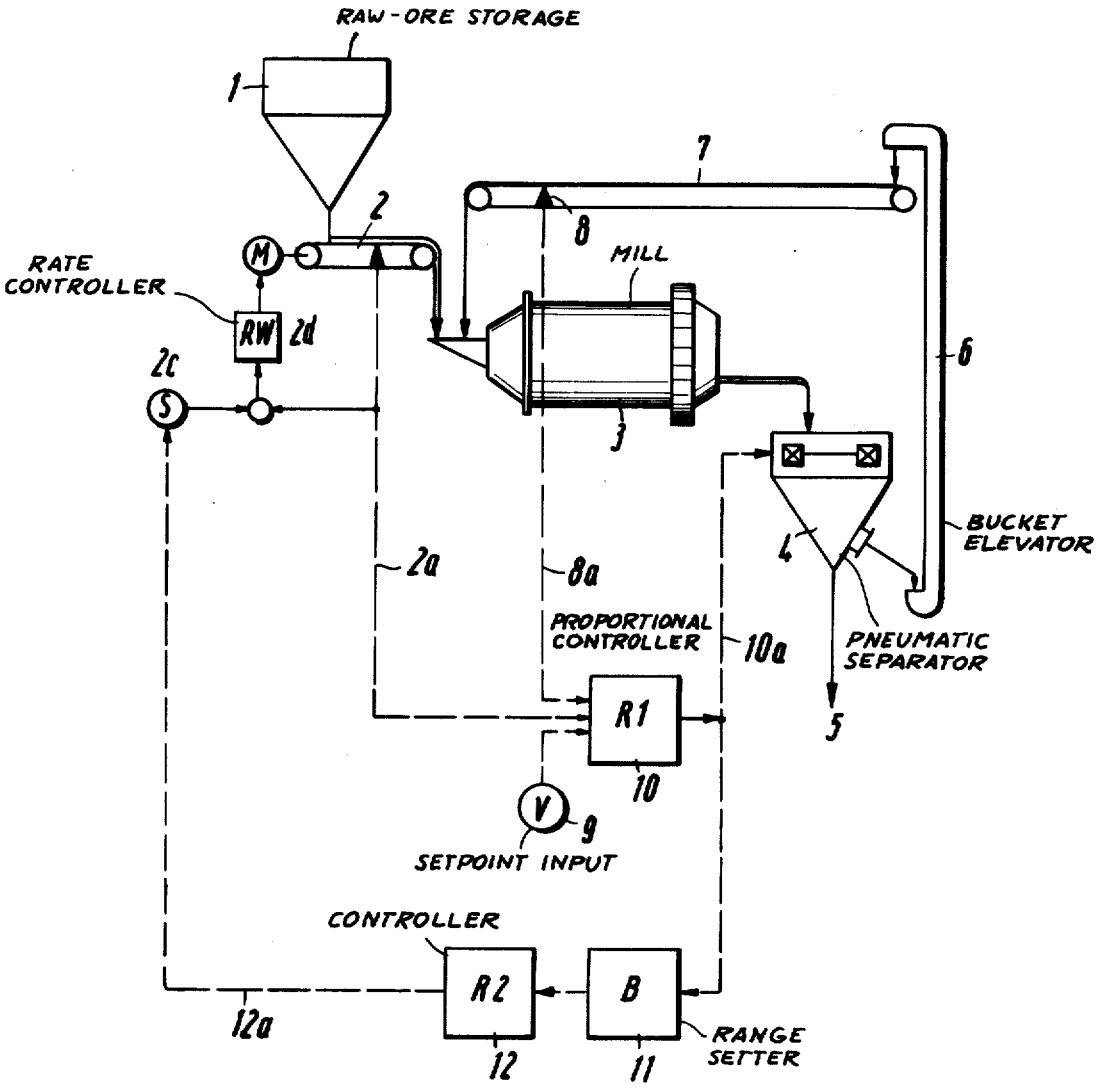
FIG. 1 is a flow diagram of an apparatus for carrying out the process of the present invention in an experimental scale.

FIG. 1 shows a flow diagram of a system for experimentally carrying out the process of the invention, e.g. for the comminution of raw iron ore to form the same into particles suitable for pelletizing and subsequent refining.

The basic apparatus comprises a storage bin 1 for the raw ore and a metering conveyor 2 onto which this storage bin 1 discharges the raw ore. The raw ore is fed by the conveyor 2 to a tube mill 3 of the type described previously, the output of the tube mill 3 communicating with a centrifugal separator of the type described in the aforementioned VEB Deutscher Verlag fur Grundstoffindustrie publication.

The ground product of uniform fineness is discharged at 5 and the coarse fraction is carried by a bucket conveyor 6 to a conveyor 7 by which it is recycled to the inlet of the mill 3. A proportional controller 10 has a ratio input 9 while a range setter 11 responds to the parameter of the separator 4. The functioning of the various controllers will be described in greater detail below.

Raw ore is withdrawn from the storage bin 1 and fed to a mill 3 under control by a weighing and metering belt conveyor 2. The rate controller **2*d* (chapter 22, pages 71 ff. Perry's Chemical Engineers' Handbook, McGraw-Hill, N.Y. 1963) ensures that the weighing and metering belt conveyor discharges at a set rate (signal 2*c*). The ground material is classified in a centrifugal pneumatic separator 4. The coarse fraction is recycled to the mill 3 by means of a bucket elevator 6 and a belt conveyor 7 and the remaining fine fraction is discharged as finished product 5**.

The recycle rate is measured with a weighing belt conveyor 8 and the signal **8*a* representing the measured recycle rate is applied to a proportional controller 10 (chapter 21, pages 71, 78, 83, op.cit.). The latter computes the ratio of the recycle rate (signal 8a) to the raw ore feed rate (signal 2a) and compares this ratio to a set ratio (signal 9). When the recycle ratio differs from the set ratio, the output signal 10a of controller 10 changes the speed of the pneumatic separator 4 in such a manner that the recycle ratio is maintained substantially constant at the set value. The output signal 10a for controlling the speed of the pneumatic separator is fed through a unit 11 to a controller 12 (op.cit.). The unit 11 serves to set the permissible deviation, i.e., the range within which the automatic control is effected only by a change of the speed of the pneumatic separator. When the set permissible deviation is exceeded, the controller 12 changes the set discharge rate (signal 2c) of the weighing and metering belt conveyor 2** and thus changes the raw ore feed rate.

Figure 2:
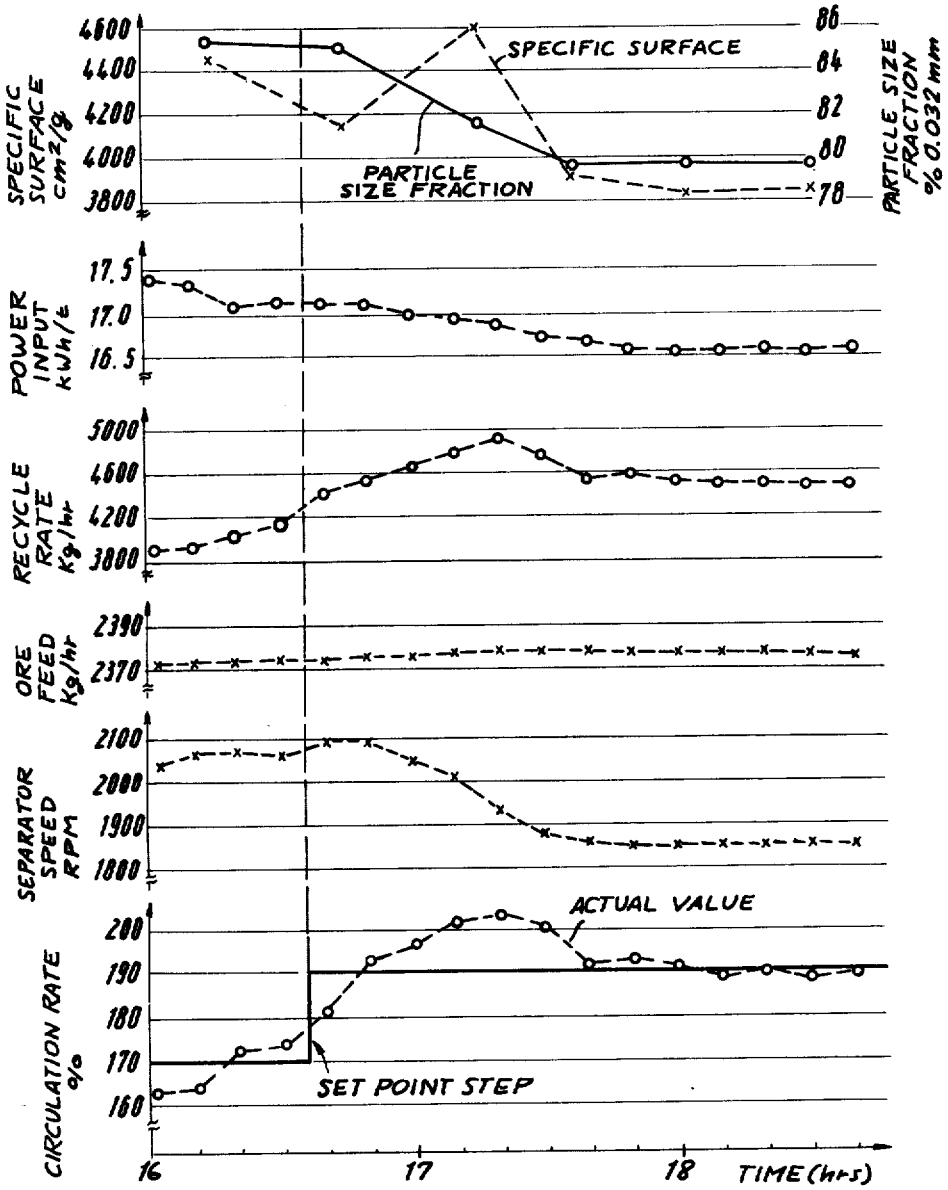
FIG. 2 is a set of graphs illustrating the parameters of the present invention according to a specific example thereof.

FIG. 2 represents results of experiments. It is apparent that the set recycle ratio has been changed from 170% to 190% and the recycle ratio has subsequently increased to 200% and has then been maintained at 190%. As a result, the specific surface of the finished product increased to 4600 $cm^2/g$. Because a hematite-limonite ore was being processed, the finished product consisted mainly of the easily grindable limonite during this time whereas the hematite was recycled. All curves show that the plant was subsequently operated under constant conditions.

The advantages afforded by the invention reside mainly in that a satisfactory and optimum operation is enabled and a uniform, finished product of high quality is constantly produced. It is surprising that the rate at which the coarse fraction is recycled can be relatively strongly changed in conjunction with only a slight change of the quality of the finished product.

We claim:

1. A process for dry grinding ore to produce pelletizable particles which comprises the steps of:

a. grinding ore in a size-reducing unit;

b. classifying the ground ore in a centrifugal pneumatic separator into a coarse fraction and a fine fraction, said centrifugal pneumatic separator having a controllable operating parameter;

c. recycling the coarse fraction into the size-reducing unit;

d. discharging the fine fraction as a finished product; and e. maintaining a substantially constant total rate of ore feed and recycled coarse fraction feed to said size-reducing unit by maintaining the ratio of the ore-feed rate to the coarse fraction recycled rate substantially constant, automatically controlling the centrifugal pneumatic separator to make said coarse fraction available with a varying particle size fraction at a substantially constant rate, and varying the ore-feed rate when and only when, said controllable variable of the pneumatic separator has a deviation in excess of a predetermined permissible deviation.

2. The process defined in claim 1 wherein the automatic control of the centrifugal pneumatic separator is effected by changing the speed of a fan of said pneumatic separator.

3. The process defined in claim 1 wherein the permissible deviation of he controllable variable of the centrifugal pneumatic separator is the permissible deviation of the particle size spectrum of the finished product and the ore-feed rate is changed when this permissible deviation is exceeded.

4. The process defined in claim 1 wherein the ore-feed rate is changed in steps when the permissible deviation has been exceeded.

* * * * *